US005884782A

United States Patent [19]

Dembicks

[11] Patent Number: 5,884,782

[45] Date of Patent: Mar. 23, 1999

[54] FRANGIBLE RACK SYSTEM FOR A TOOL CHEST

[76] Inventor: Andrew E. Dembicks, 5308 Boca Marina Cir. North, Boca Raton, Fla. 33487

[21] Appl. No.: 897,911

[22] Filed: Jul. 21, 1997

[51] Int. Cl.[6] ..... A47F 1/04

[52] U.S. Cl. ..... 211/70.6; 211/175; 211/184

[58] Field of Search ..... 211/70.6, 184, 211/175; 248/909; 206/376; 220/529; 312/348.3, 902, DIG. 33

[56] References Cited

U.S. PATENT DOCUMENTS

| | | | |
|---|---|---|---|
| 2,111,357 | 3/1938 | Cornell, Jr. | 248/909 |
| 3,837,477 | 9/1974 | Boudreau | 206/376 X |
| 3,892,451 | 7/1975 | Bruins . | |
| 4,488,653 | 12/1984 | Belokin | 248/909 X |
| 4,705,168 | 11/1987 | Ward . | |
| 4,901,869 | 2/1990 | Hawkinson et al. . | |

OTHER PUBLICATIONS

Snap–On Tools Catalog, 1995, p. 37.

*Primary Examiner*—Blair M. Johnson
*Attorney, Agent, or Firm*—Quarles & Brady

[57] ABSTRACT

A length adjustable rack for organizing and holding tools in a tool chest drawer. The rack is comprised of an elongated base member and a vertically upstanding body extending from the base member over substantially an entire length thereof. The body has at least one upwardly facing recess defined along a portion of its length. An end cap configured for attachment to the body is provided on an end thereof. Further, a frangible shear section is provided along a portion of the elongated body and the elongated base member. A key member formed on the end of the body is provided and configured for securing the end to the end cap. At least one additional key member is provided adjacent to the frangible shear section, and the additional key member is exposed for engagement with a locking portion of the end cap when the adjustable rack is flexed at the shear section and an excess portion of the length is removed.

13 Claims, 4 Drawing Sheets

FRANGIBLE RACK SYSTEM FOR A TOOL CHEST

CROSS REFERENCE TO RELATED APPLICATIONS (Not Applicable)

STATEMENT REGARDING FEDERALLY SPONSORED RESEARCH OR DEVELOPMENT (Not Applicable)

BACKGROUND OF THE INVENTION

1. Technical Field

This invention relates to rack systems for tools, and more particularly to a frangible rack for mounting in a tool chest drawer having a pre-determined size.

2. Description of the Related Art

A wide variety of rack systems exist for organizing and holding tools in a tool chest drawer. Typically, these rack systems include one or more rack members which are capable of securely positioning one or more tools, such as a combination wrench, in a fixed position within the drawer. Thus, a series of tool receiving fixtures may be provided, preferably with some means for the rack to be secured within the drawer. One such system is disclosed in U.S. Pat. No. 4,705,168 to Ward for a Drawer Divider System. In that reference, a drawer divider is disclosed which is comprised of an elongated body having a series of recesses formed therein, and a pair of integrally formed sidewall engagement portions on either end of the elongated body.

One problem with rack systems such as those disclosed in the Ward reference is that they are not easily adjustable in length due to the fact that it is formed as a single molded unit with integral sidewall engagement portions. As a result, such racks must be specifically configured for a particular sized drawer. Since there are many different sizes and styles of tool chest drawers, the fixed length of these types of rack systems severely limits their usefulness in mass marketing applications where a variety of drawer sizes must be accommodated. Moreover, even in the case where there are only several different size drawers which must be accommodated, the additional molding costs and shelf space required for manufacturing and stocking rack units of various lengths makes them commercially less attractive than other similar systems.

Typical rack units such as the one disclosed in the Ward reference are often fabricated from a thermoplastic resin such as polypropylene. Such materials are versatile and exhibit substantial toughness when molded in a configuration such as the one disclosed in Ward. For example, when used in products such as those described in Ward, they exhibit structural properties which include a resilience and resistance to breakage when flexed. These features are desirable for tool racks to be used for the purpose disclosed, but cause difficulty when there is a need for a consumer to alter the length of the tool rack for use in a particular size tool chest drawer. In other words, the tool rack is difficult to cut or break to a desired length to fit a particular drawer. Thus, aside from the use of an integral sidewall engagement portion in the Ward reference, a substantial problem is presented in order to provide a rack which can have an adjustable length.

Finally, in addition to the difficulty in fitting integrally molded, single unit rack systems in a particular size tool chest drawer, a further problem remains as to how the side wall engaging portion of the unit can be securely attached to the remainder of the rack once the rack has been cut to size. This is a problem of some concern as the end portion of a rack which has been cut to size will generally not be suitable for receiving a sidewall engagement portion thereon without further cutting and trimming.

Accordingly, it would be desirable to provide a rack unit for accommodating a variety of different sized tool chest drawers. It would also be desirable to provide a rack unit which can be fitted to a variety of different sized drawers without the need for specialized cutting or adjustment tools. It would be still further desirable to provide a frangible rack unit which can lockingly engage a resilient end cap at a portion of said rack where a portion of the rack has been removed.

SUMMARY OF THE INVENTION

A length adjustable rack for organizing and holding tools in a tool chest or cabinet drawer. The rack is comprised of an elongated base member and a vertically upstanding body extending from the base member over substantially an entire length thereof. The body has at least one upwardly facing recess defined along a portion of its length. An end cap configured for attachment to the body is provided on an end thereof. Further, a frangible shear section is provided along a portion of the elongated body and the elongated base member. A key member formed on the end of the body is provided and configured for securing the end to the end cap. At least one additional key member is provided adjacent to the frangible shear section, and the additional key member is exposed for engagement with a locking portion of the end cap when the adjustable rack is excessively flexed at the shear section and an excess portion of the length of the rack is removed.

In one embodiment, the shear section is comprised of a portion of the base member and the body having a reduced cross-sectional area. The base member has a pair of opposing longitudinal edges, and a cross sectional area of the base member is reduced in the shear section in an area extending from a central longitudinal axis of the base member toward the edges. The cross-sectional area of the base member is further reduced in the shear section by means of a notch extending from the opposing edges toward the central longitudinal axis. The cross sectional area of the body is reduced in the shear section by a notch extending from the portion of the body adjacent to the base to an opposing edge of the body. The notch in the body extends to a portion of the opposing edge defining the at least one upwardly facing recess. The key member comprises a thickened edge of the end of the body and extends upwardly along at least a portion thereof. A locking portion is defined on the end cap for receiving the key member therein. The locking portion is comprised of a profiled slot defined in the end cap.

BRIEF DESCRIPTION OF THE DRAWINGS

There are shown in the drawings embodiments which are presently preferred, it being understood, however, that the invention is not limited to the precise arrangements and instrumentalities shown, wherein.

DETAILED DESCRIPTION

Figure 1:
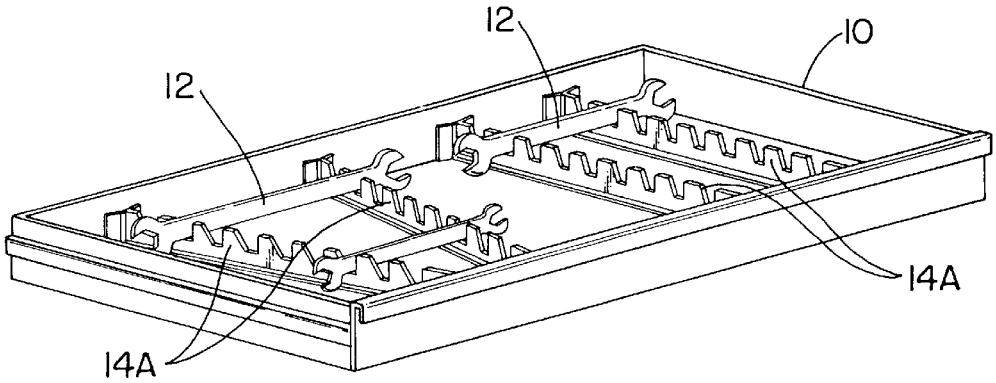
FIG. 1 (PRIOR ART)
FIG. 1 is a perspective view of a tool chest drawer in which a tool rack of the prior art is shown mounted.
Figure 2:
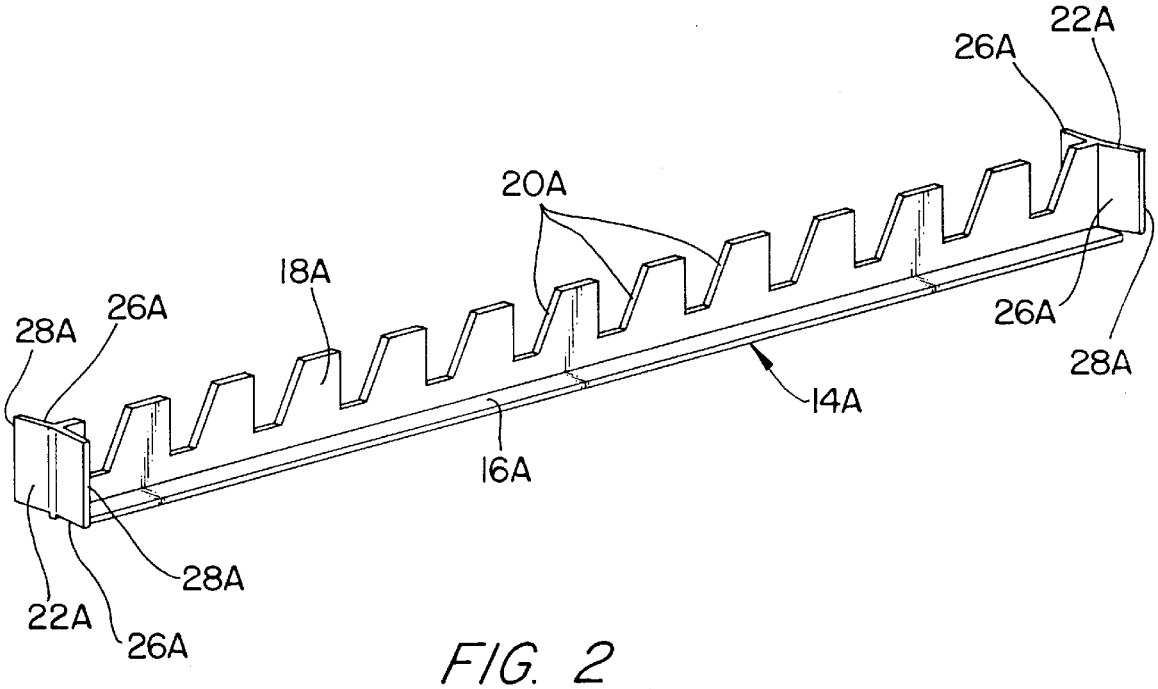
FIG. 2 (PRIOR ART)
FIG. 2 is an enlarged perspective view of the tool rack shown in FIG. 1

FIGS. 1 and 2 illustrate a conventional tool rack 14A of the prior art which is designed to be mounted in a tool chest drawer 10. Tools 12 may be positioned on pairs of adjacently mounted racks in recesses 20A formed on body portion 18A. The rack includes an elongated base 16A and a pair of opposing end caps 22A which are integrally formed with the base 16A and the body 18A. The end caps include a pair of resilient arms 26A which flare outwardly from the body portion to a pair of sidewall engaging tips 28A. The resiliency of the arms 26A exerts sufficient force at the point where the arms contact the side walls of drawer 10 to securely hold the tool rack in place therein in the manner shown in FIG. 1.

Figure 3:
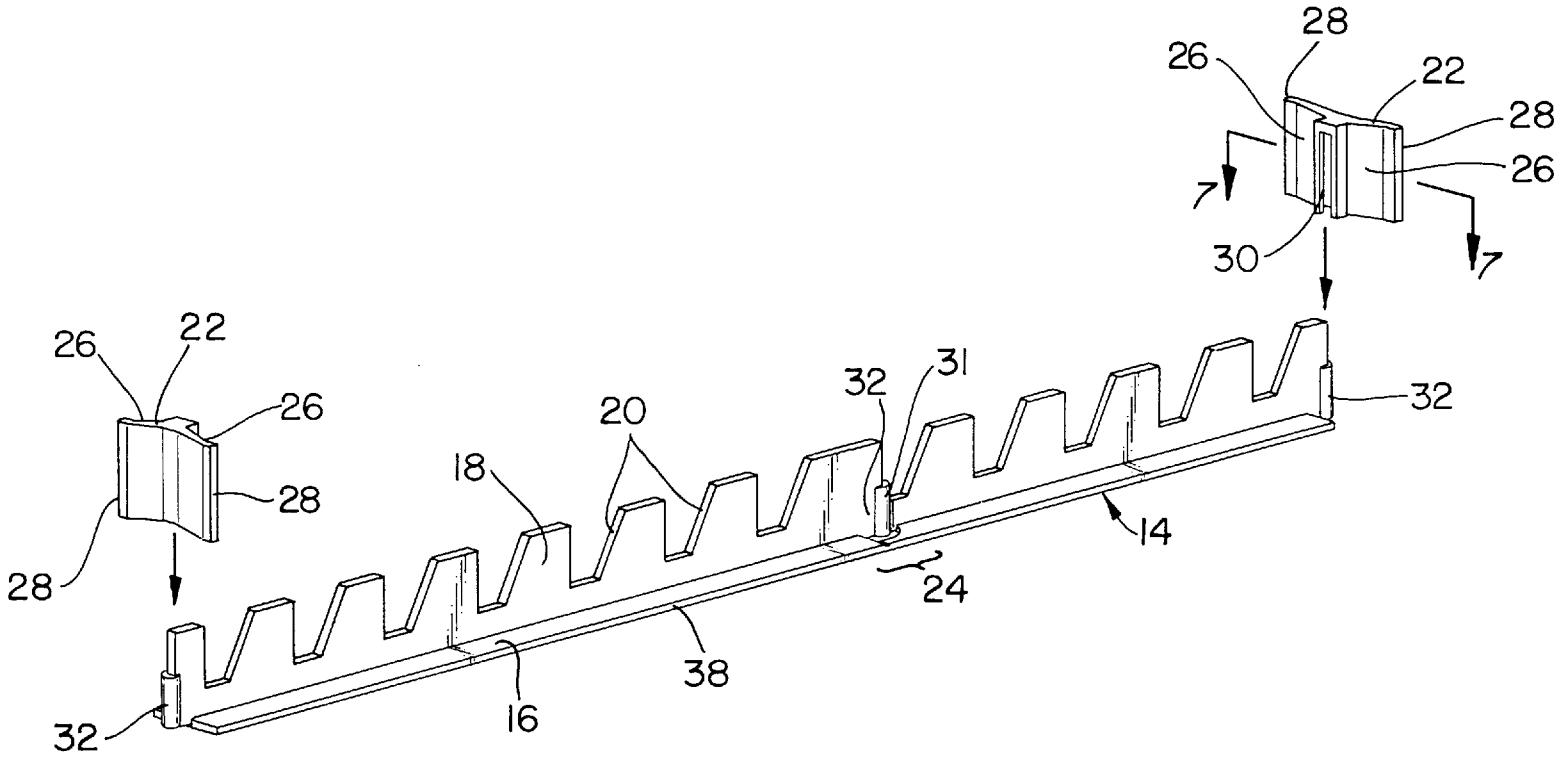
FIG. 3 is a perspective view of a tool rack according to the invention.

FIG. 3 is an improvement over rack systems of the prior art such as the one shown in FIGS. 1 and 2. As shown in FIG. 3, the rack includes an elongated base member 16, a body portion 18 extending vertically upright from the base member and a pair of end caps 22 configured for attachment to the body portion 18. The body portion 18 has one or more recesses 20 which are provided for receiving a tool therein. The end caps have resilient arms 26 and sidewall engaging tips 28 which serve the same purpose as the corresponding elements shown in FIGS. 1 and 2. The rack 14 is preferably manufactured from a thermoplastic material by injection molding, with a preferred plastic material being polypropylene. The use of plastic in this regard is advantageous as it provides a limited resiliency to the part, while also facilitating a removal of an unwanted length portion of the rack 14 as shall hereinafter be described.

As shown in FIG. 3, the end caps 22 differ from those of the prior art in FIG. 1 in that the caps are not integrally formed with the body 18 and base 16. Instead, the end caps 22 are provided with a locking portion in the form of a slot 30 which is configured to interfit with a key member 32. Key member 32 is comprised of a thickened end portion 31 of body member 18 as shown in FIG. 3. The thickened end portion 31 preferably extends at least partially along the end of the body member and is profiled for interlocking engagement with slot 30 formed in end cap 22.

Figure 7:
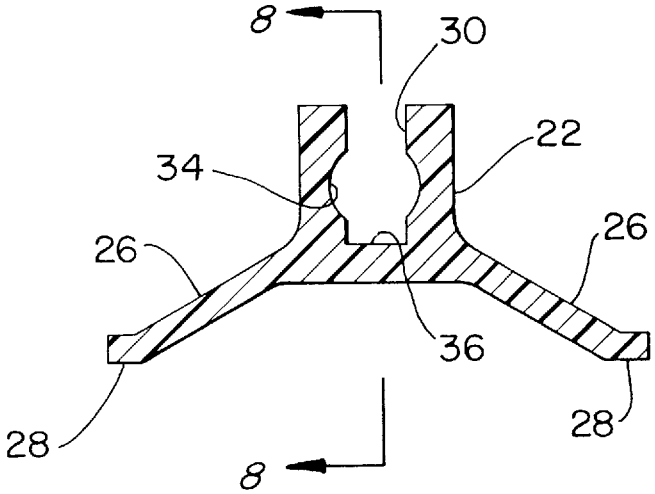
FIG. 7 is a cross sectional view of the end cap in FIG. 3 taken along line 7—7.
Figure 8:
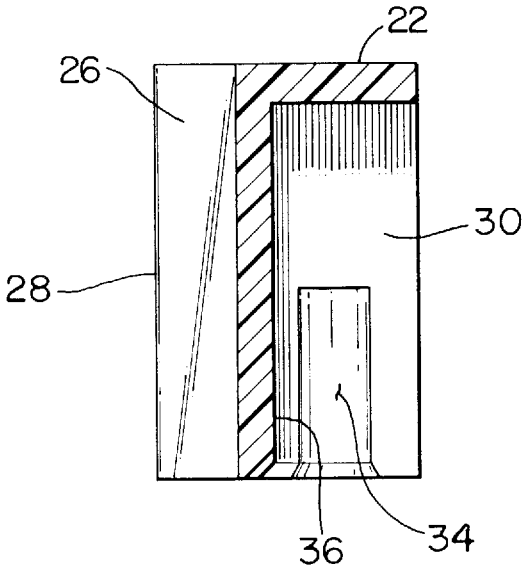
FIG. 8 is a cross sectional view of the end cap in FIG. 7 taken along line 8—8.

As better shown in FIGS. 7 and 8, the locking portion of end cap 22 is comprised of slot 30, which is provided with a profiled section 34 for sliding engagement with the thickened end portion 31 of key member 32. In FIGS. 1–8, the thickened end portion of key member 32 has a cross-sectional profile which is roughly cylindrical, as does the profiled section 34. It should be noted however, that the invention is not limited in this regard and any other suitable profile may also be used for this purpose.

Figure 4:
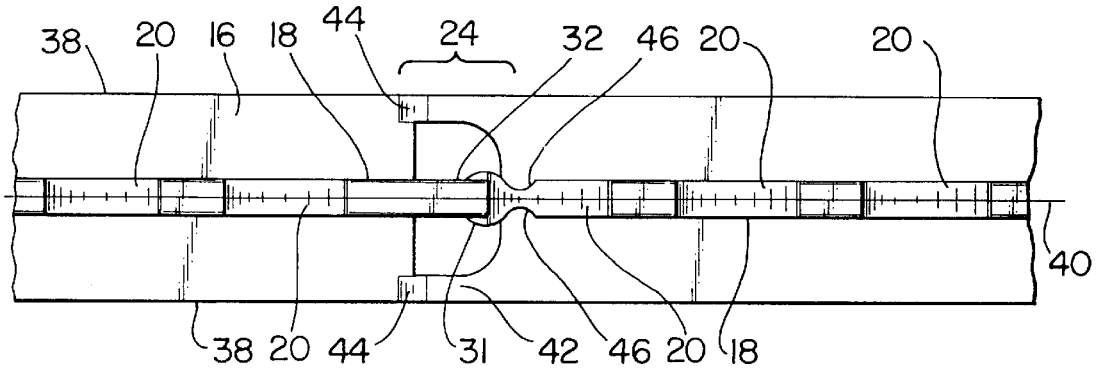
FIG. 4 is a top view of the tool rack in FIG. 3.

As shown in FIGS. 3–6, the rack 14 includes a frangible shear section 24 which is specifically configured to permit removal of a portion of the length of the rack 14 which exceeds that which is suitable for a particular tool chest drawer. The shear section 24 has a reduced cross-sectional profile due to the removal of a portion of the base 16 and a notching of the body 18 in this area of the rack. More particularly, as shown in FIG. 4, base member 16 has a pair of opposing longitudinal edges 38, and the cross sectional area of the base member is reduced in the area extending from a central longitudinal axis 40 of the base member toward the edges 38. The reduction in cross-sectional area is accomplished by removal of a portion of the material comprising the base, so that the base is joined together only by a pair of relatively narrow strips 42 extending along each edge. In a preferred embodiment, the strips 42 are provided with a notched portion 44 extending inwardly from edges 38, toward the central longitudinal axis 40.

It should be noted that while only a single shear section is shown in FIGS. 3–8, it is contemplated that two or more shear sections may be provided on a rack unit as shown in order to accommodate a variety of different sized drawers.

In a preferred embodiment, the cross sectional area of the rack 14 is further reduced in the shear zone by means of a notched portion 46 extending from an edge of the body 18 adjacent to base 16, to an opposing edge of the body. In order to still further reduce the surface area of the body in the shear zone, the notch can be advantageously aligned with one of the upwardly facing recesses 20.

Figure 5:
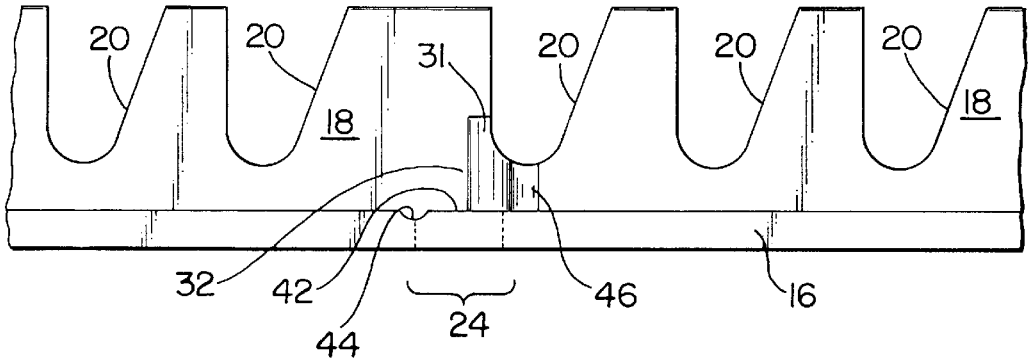
FIG. 5 is a side elevation view of the tool rack in FIG. 3.
Figure 6:
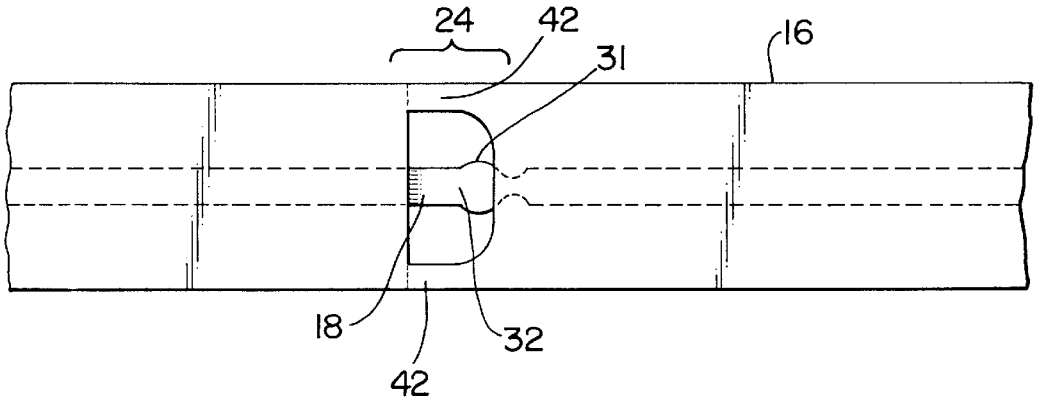
FIG. 6 is a bottom view of the tool rack in FIG. 3.

As shown in FIGS. 4–5, the shear zone includes a key member 32 formed on the body 18 adjacent to the notch 46. Thus, when the rack 14 is excessively flexed so as to cause the frangible shear section 24 to separate, the key member 32 will be exposed for receiving an end cap 22 thereon. Significantly, the removal of a portion of said material comprising the base 16 in the shear zone, as shown in FIG. 4, to reduce its cross-sectional area, has the complimentary advantage of also making room for the lower portion of the end cap 22 to be accommodated when the end cap 22 is engaged with the key member 32 which has been exposed.

FIGS. 3–8 illustrate one specific embodiment for reducing the cross-sectional area of the rack 14 to achieve frangibility, while also providing a key member which is exposed as a result of a detachment of an excess length of the rack 14. It should be recognized however, that the invention is not limited to the precise embodiment shown. Other implementations to achieve the same result are possible, provided that the rack member retains sufficient structural stability to accommodate any flexing necessary for ordinary installation and use, while also permitting a pre-determined amount of excess rack length to be removed by over-flexing the rack at a shear zone to expose a key member. Likewise, the key member 32 and locking portion of end caps 22 are not limited to the precise interlocking configuration as shown, but may comprise any other arrangement suitable for locking these two components together.

What is claimed is:

1. A length adjustable rack for holding tools in a tool chest drawer, said rack comprising:

an elongated base member;

a vertically upstanding body extending from said base member over substantially an entire length thereof, said body having at least one upwardly facing recess defined along a portion of its length;

an end cap configured for attachment to said body on an end thereof;

said body and said base member provided with a frangible shear section, said frangible shear section having portions longitudinally and vertically offset from one another;

whereby said adjustable rack may be reduced in size to fit a drawer size which is less than said length by flexing said rack at said shear section to remove an excess portion.

2. The adjustable rack according to claim 1 wherein said shear section is comprised of a portion of at least one of said base member and said body having a reduced cross-sectional area.

3. The adjustable rack according to claim 2 wherein said base member has a pair of opposing longitudinal edges, and a cross sectional area of said base member is reduced in said shear section in an area extending from a central longitudinal axis of said base member toward said edges.

4. The adjustable rack according to claim 3 wherein said cross-sectional area of said base member is further reduced in said shear section by means of a notch extending from said opposing edges toward said central longitudinal axis.

5. The adjustable rack according to claim 2 wherein said cross sectional area of said body is reduced in said shear section by a notch extending from said base to an opposing edge of said body.

6. The adjustable rack according to claim 5 wherein said notch extends to a portion of said opposing edge defining said at least one upwardly facing recess.

7. The adjustable rack according to claim 5 further comprising a key member formed on said body adjacent to said notch.

8. The adjustable rack according to claim 7 wherein said key member is exposed for engagement with a locking portion of said end cap when said excess portion is removed.

9. The adjustable rack according to claim 1 further comprising a key member formed on said end of said body, said key member configured for securing said end to said end cap.

10. The adjustable rack according to claim 9 wherein said key member comprises a thickened edge of said end extending along at least a portion thereof.

11. The adjustable rack according to claim 10 further comprising a locking portion defined on said end cap, said locking portion for receiving said key member therein.

12. The adjustable rack according to claim 11 wherein said locking portion is comprised of a profiled slot defined in said end cap.

13. A length adjustable rack for holding tools in a tool chest drawer, said rack comprising:

an elongated base member;

a vertically upstanding body extending from said base member over substantially an entire length thereof, said body having at least one upwardly facing recess defined along a portion of its length;

an end cap configured for attachment to said body on an end thereof;

a frangible shear section provided along a portion of said body and said base member, said frangible shear section having portions longitudinally and vertically offset from one another;

a key member formed on said end of said body, said key member configured for securing said end to said end cap; and at least one additional key member provided adjacent to said frangible shear section, said additional key member exposed for engagement with a locking portion of said end cap when said adjustable rack is flexed at said shear section and an excess portion of said length is removed.

* * * * *